United States Patent [19]

Ravn

[11] 3,946,914

[45] Mar. 30, 1976

[54] ARRANGEMENT FOR SECURING A NOZZLE TO A CONTAINER

[75] Inventor: Ole Stig Ravn, Farum, Denmark

[73] Assignee: Stig Ravn A/S, Denmark

[22] Filed: Nov. 21, 1974

[21] Appl. No.: 525,987

[30] Foreign Application Priority Data

Nov. 22, 1973 Denmark ..... 6319/73

[52] U.S. Cl. ..... 222/574; 220/67; 229/5.6

[51] Int. Cl.[2] ..... B65D 25/42

[58] Field of Search ..... 222/566, 574; 220/67; 229/5.6

[56] References Cited

UNITED STATES PATENTS

| | | | |
|---|---|---|---|
| 2,887,240 | 5/1959 | Deussen | 222/566 X |
| 3,058,642 | 10/1962 | Hester | 229/5.6 UX |
| 3,662,944 | 5/1972 | Joosten | 229/5.6 X |

*Primary Examiner*—Robert B. Reeves
*Assistant Examiner*—Frederick R. Handren
*Attorney, Agent, or Firm*—Watson, Cole, Grindle & Watson

[57] ABSTRACT

An arrangement for securing a nozzle to a container comprising a flange arranged at the inner end of the nozzle, and a piece of a metal sheet wherein a hole is provided, the delivery end of said nozzle extending through said hole and said flange abutting said metal sheet around said hole, the circumferential portion of said piece of metal sheet having a width such as to form a curl around an edge of the container defining an opening therein, a thin lip being provided along the outer circumference of the flange, said lip having a width such as to form a curl around the end of the container between the container and the curl of the piece of metal sheet.

4 Claims, 4 Drawing Figures

ARRANGEMENT FOR SECURING A NOZZLE TO A CONTAINER

BACKGROUND OF THE INVENTION

This invention relates to an arrangement for securing a nozzle to a container containing a material to be dispensed from the container, e.g., a sealing or filler compound which e.g., by means of a piston is intended to be pressed into a joint through the nozzle. It is well-known in the art to secure a nozzle of the kind here in question to the edge of the container by means of a metal sheet disc comprising a central opening. The delivery end of the nozzle extends through the hole and a flange arranged around the inner end of the nozzle about the disc around the hole. The outer circumferential portion of the disc is arranged to be secured to the edge of the container by being bent around the edge so as to form a curl or bead.

In the known arrangement the nozzle is secured solely by engagement of the edge of the hole in the disc into a low circumferential groove provided at the inner end of the nozzle adjacent the flange.

Nozzles of the kind here in question are used e.g., for containers containing sealing materials and the containers may contain a piston which by means of a simple pressing device may be moved towards the nozzle. Accordingly, the content of the container, e.g., a filler compound, is pressed through the nozzle and by moving the nozzle along a joint, the sealing compounds may be pressed into the joint.

By using the known securing arrangement referred to above, wherein the nozzle is secured due to engagement of the edge around the hole in the disc, and the groove in the nozzle and due to abutment of the flange of the nozzle against the disc, leakage may occur between the nozzle and the disc, e.g., if the delivery end of the nozzle is pressed against elements defining the joint to be filled. If such leakage occurs, the content of the container may be ejected around the nozzle instead of through the nozzle. Moreover, such leakage may result in evaporation of solvents or plasticizers from the content of the container which makes the content useless.

SUMMARY OF THE INVENTION

According to the present invention, a thin lip is provided along the circumference of the flange and this lip is adapted so as to be secured to the edge of the container by means of the edge of the disc. Due to the fact that such lip, when the disc is secured to the edge of the container, will be bent together with the edge of the disc, the lip will serve a double object seeing that the lip will seal the joint between the edge of the disc and the edge of the opening and simultaneously the lip will add in securing the flange with respect to the disc in such a way that a tipping over of the nozzle in the hole of the disc is prevented. Accordingly, permanent security against inadvertent issue of the material in question through the nozzle and security against escape of components from the container are achieved.

DESCRIPTION OF THE PREFERRED EMBODIMENT

Figure 1:
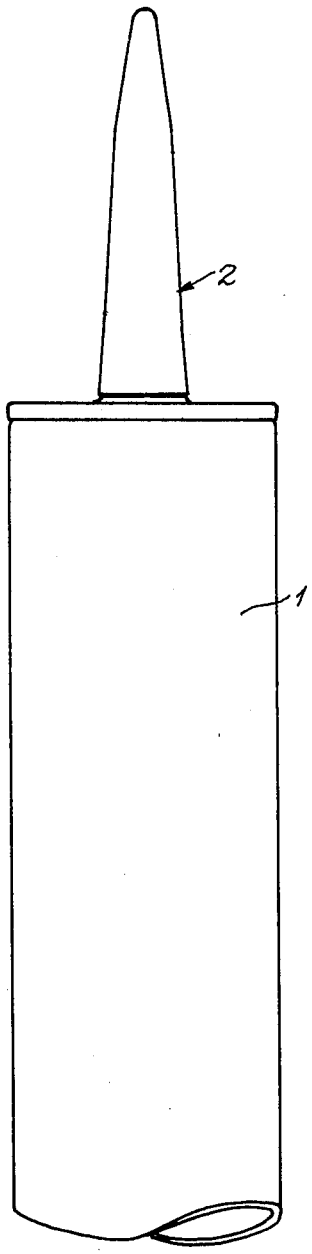
FIG. 1 is a side view of a portion of a container to which a nozzle is secured according to the present invention.
Figure 2:
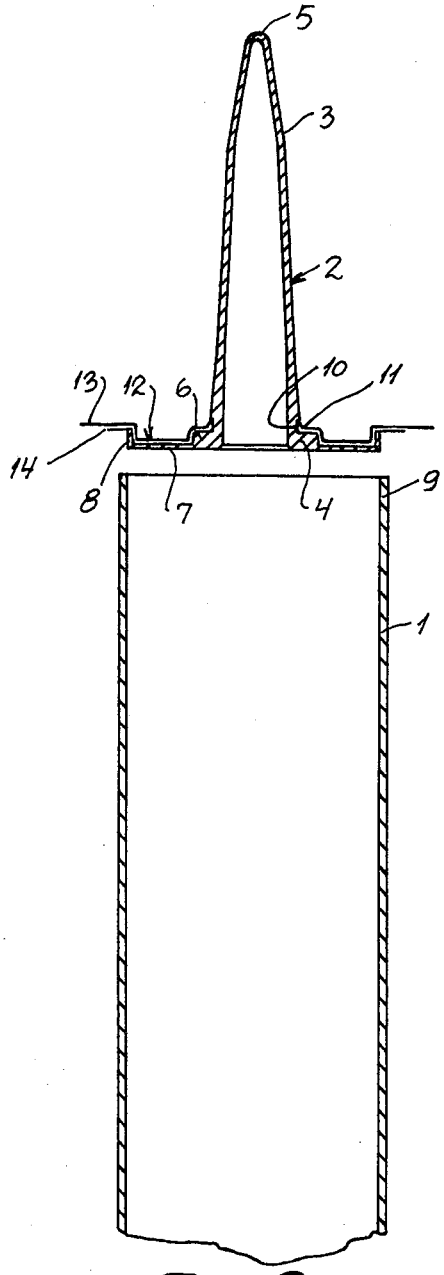
FIG. 2 is a longitudinal cross-section of the embodiment shown in FIG. 1 for illustrating the mutual positions and forms of the parts of the arrangements prior to the securing of the nozzle to the container.
Figure 3:
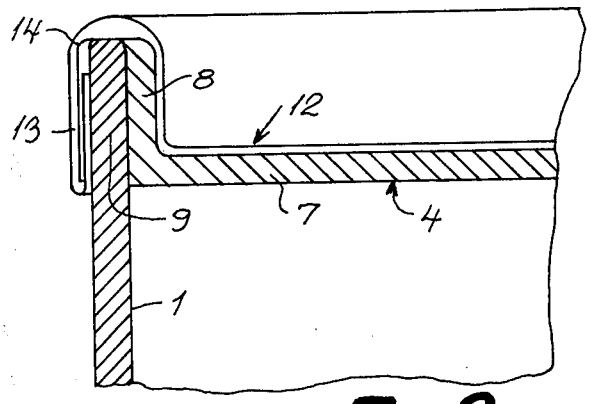
FIG. 3 is a sectional view of the completed securing arrangement between the nozzle and the container.
Figure 4:
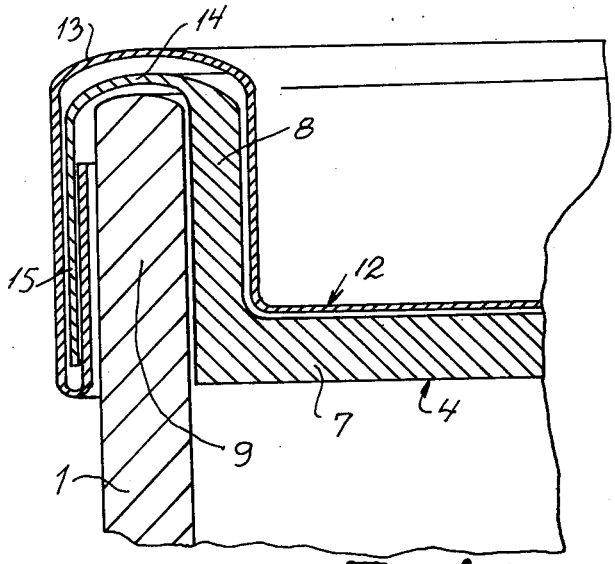
FIG. 4 is a sectional view corresponding to FIG. 3 but on an increased scale.

On the drawing, 1 is a container, e.g., a cardboard tube, e.g., for accomodating printing ink or a like viscous material. A nozzle 2 made of plastic material is secured to one end of the cylinder 1. As illustrated in FIG. 2 the nozzle 2 comprises a spout 3 and a flange 4 at the inner end. The spout 3 is closed at the delivery end 5, but may be opened by severing the tip of the spout. The flange 4 comprises an inner comparatively thick portion 6 and an outer comparatively thin, radially extending, circumferential portion 7, which at the outer edge thereof merges into an axially extending collar 8. The collar fits into the opening 9 in the cylinder 1. At the transition between the spout 3 and the thick flange portion 6 a circumferential groove 10 is provided for engagement with the edge 11 of a hole provided in a piece of metal sheet 12. As it appears from FIG. 2, the edge 11 surrounding the hole is gently curved in order to increase the engagement with the groove 10. The contour of the piece of metal sheet 12 generally corresponds to the contour of the upper surface of the flange 4, but the metal sheet has an edge portion 13 extending beyond the flange. This outwardly extending edge portion 13 is intended to secure the metal sheet with respect to the edge 9 of the container. FIGS. 3 and 4 clearly illustrate how the nozzle is secured with respect to the edge 9.

Along the upper edge of the collar 8 of the flange 4, a circumferential outwardly extending very thin lip 14 is provided, which on FIG. 3 is indicated by a single line. In the secured condition of the nozzle, this lip adds to the securing of the nozzle, viz., by being secured to the outer surface of the edge 9 of the container. This securing action is achieved by bending the outer edge 13 of the piece of metal sheet 12 about the lip 14 and pressing the fold thus formed towards the outer surface of the container. This securing is illustrated in FIG. 4 on a still further increased scale which allows the illustration of the piece of metal sheet 12 as well as the lip 14 by means of double lines. From FIG. 4 it is clearly apparent how an outer edge portion 15 of the lip is trapped between the bent outer edge 13 of the sheet 12 and is secured to the outer surface of the container 1. For the sake of clarity, the different portions of the securing arrangement are shown as being spaced from each other in FIG. 4, but it will be understood that in the finally secured condition of the nozzle no gaps exist between the bent portion of the outer edge 13, the trapped portion of the lip and the outer surface of the container 1.

It will be understood that the nozzle is mounted by pressing the delivery end 5 of the nozzle through the hole in the piece of metal sheet 12 until the edge 11 along the hole snaps into the groove 10. Now the portions are in the position shown in FIG. 2. Then the outer edge 13 of the piece of metal sheet is bent around the lip 14 and is then pressed downwardly and inwardly towards the outer surface of the container 1. However, it will be understood that many other sorts of curls or folds than the one here illustrated may be used in order to secure the piece of metal sheet 12 to the edge 9 of the container. For instance the curling of the marginal portion 13 may be carried out as known from securing can ends to a can.

I claim:

1. A tubular container having a plastic nozzle at one end thereof through which contents of the tubular container may be expelled by the application of pressure on the contents, the tubular container comprising a hollow cylindrical sleeve in which the contents of the tubular container are stored generally, a nozzle for attachment to one end of the hollow cylindrical sleeve, the nozzle comprising a hollow, centrally disposed, outwardly projecting, generally tapered spout through which the contents flow upon expulsion, a flange attached circumferentially to the proximal end of the spout and extending radially outward so as to engage the hollow cylindrical sleeve at the one end thereof, the flange having a thick portion immediately adjacent to the spout and a thin radially extending portion outboard of the thick portion, and a lip affixed to the thin radially extending portion of the flange and extending normally radially beyond the one end of the hollow cylindrical sleeve, the lip being thinner than the thin radially extending portion of the flange and being readily deformable, and a generally disc-like plate for securing the nozzle to the hollow cylindrical sleeve, the plate having a centered hole therein through which at least a major portion of the spout extends, the plate at the edges of the hole engaging the nozzle, and the marginal portion of the disc-like plate being curled over and deforming the lip of the nozzle against the end of the hollow cylindrical sleeve so as to effect a seal therebetween and to secure the nozzle to the end of the hollow cylindrical sleeve.

2. A tubular container according to claim 1, wherein the flange of the nozzle also includes a tubular axially extending collar interposed between the thin radially extending portion and the lip, the collar slidably engaging the hollow cylindrical sleeve along its inner surface.

3. A tubular container according to claim 1, wherein a circumferential groove is formed in the nozzle proximately to the attachment of the spout to the flange, and wherein the edge of the hole in the plate is curved outwardly toward the distal end of the spout and engages the circumferential groove in the nozzle.

4. A tubular container according to claim 3, wherein the disc-like plate is found to follow generally the surface of the flange of the nozzle so as to preclude excess distension thereof during application of pressure to the contents.

* * * * *